US010407144B2

(12) United States Patent
Ji

(10) Patent No.: US 10,407,144 B2
(45) Date of Patent: Sep. 10, 2019

(54) UNDERWATER SPECTACLES AND CONTROL METHOD THEREOF

(71) Applicant: BOE TECHNOLOGY GROUP CO., LTD., Beijing (CN)

(72) Inventor: Chunyan Ji, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 183 days.

(21) Appl. No.: 15/525,439

(22) PCT Filed: May 11, 2016

(86) PCT No.: PCT/CN2016/081697
§ 371 (c)(1),
(2) Date: May 9, 2017

(87) PCT Pub. No.: WO2017/133115
PCT Pub. Date: Aug. 10, 2017

(65) Prior Publication Data

US 2018/0105238 A1 Apr. 19, 2018

(30) Foreign Application Priority Data

Feb. 4, 2016 (CN) ..... 2016 1 0079581

(51) Int. Cl.
*B63C 11/12* (2006.01)
*A63B 31/00* (2006.01)
(Continued)

(52) U.S. Cl.
CPC ..... *B63C 11/12* (2013.01); *A63B 31/00* (2013.01); *A63B 33/002* (2013.01);
(Continued)

(58) Field of Classification Search
CPC ..... B63C 11/12; B63B 31/00; A63B 33/002; A63B 2225/50; A63B 2230/04
See application file for complete search history.

(56) References Cited

U.S. PATENT DOCUMENTS

2007/0015586 A1* 1/2007 Huston ..... A63B 24/0021 463/42
2007/0033717 A1 2/2007 Anderson
(Continued)

FOREIGN PATENT DOCUMENTS

CN 104548511 A 4/2015
CN 204522167 U 8/2015
(Continued)

OTHER PUBLICATIONS

First Chinese Office Action dated May 22, 2017.

*Primary Examiner* — Tajash D Patel
(74) *Attorney, Agent, or Firm* — Dilworth & Barrese, LLP.; Michael J. Musella, Esq.

(57) ABSTRACT

Provided are underwater spectacles, including a spectacle holder, spectacle belts and an intelligent control system. The intelligent control system includes a warning device, a microprocessor and a plurality of radars. The plurality of radars are respectively disposed on the spectacle holder and the spectacle belts. Input ends of the microprocessor are respectively connected with the plurality of radars, and an output end of the microprocessor is connected with the warning device. The microprocessor acquires signals of the radars, determine obstacle information and/or danger avoiding information around the head of a user, and send the information to the warning device. The warning device receives and provides the user with the obstacle information and/or the danger avoiding information. A control method of the underwater spectacles is also provided.

19 Claims, 2 Drawing Sheets

(51) Int. Cl.
*A63B 33/00* (2006.01)
*A63B 71/06* (2006.01)

(52) U.S. Cl.
CPC .... *A63B 71/0622* (2013.01); *A63B 2033/004* (2013.01); *A63B 2071/0625* (2013.01); *A63B 2220/806* (2013.01); *A63B 2225/50* (2013.01); *A63B 2230/04* (2013.01); *B63C 2011/121* (2013.01)

(56) References Cited

U.S. PATENT DOCUMENTS

| | | | | |
|---|---|---|---|---|
| 2011/0270522 | A1* | 11/2011 | Fink ..... | G09G 5/377 701/532 |
| 2015/0343294 | A1* | 12/2015 | Leech ..... | A63B 69/3608 473/209 |

FOREIGN PATENT DOCUMENTS

| | | | |
|---|---|---|---|
| CN | 104881958 | A | 9/2015 |
| CN | 204684582 | U | 10/2015 |
| CN | 105205991 | A | 12/2015 |
| CN | 204815560 | U | 12/2015 |
| CN | 204996079 | U | 1/2016 |
| CN | 205460752 | U | 8/2016 |
| DE | 202014000402 | U1 | 10/2015 |

* cited by examiner

UNDERWATER SPECTACLES AND CONTROL METHOD THEREOF

TECHNICAL FIELD

Embodiments of the present disclosure relate to underwater spectacles and a control method thereof.

BACKGROUND

Swimming and diving are popular sports programs. During swimming and diving, it is easily to be collided due to complex underwater environment, and the swimmer or diver has to know the underwater environment. To avoid injury, especially to avoid damage to the head, the underwater situation is needed to know in real time. However, as human eyes cannot be kept open in the water environment for a long time, the sportsman or women usually need to wear swimming goggles or diving masks during swimming and diving.

SUMMARY

At least one embodiment of the present disclosure provides underwater spectacles, comprising: a spectacle holder, spectacle belts for wearing and fastening, and an intelligent control system. The intelligent control system comprises a warning device, a microprocessor and a plurality of radars; the plurality of radars being respectively disposed on the spectacle holder and/or the spectacle belts; input ends of the microprocessor being respectively connected with the plurality of radars; an output end of the microprocessor being connected with the warning device; the microprocessor being configured to acquire signals of the radars, determine obstacle information and/or danger avoiding information around the head of a user wearing the underwater spectacles according to the signals, and send the information to the warning device; and the warning device being configured to receive and provide the user with the obstacle information and/or the danger avoiding information.

In an example, the warning device comprises a display module which is configured to provide the obstacle information and/or the danger avoiding information to the user via images.

In an example, the display module comprises an image converting component and an optical amplifying component; the image converting component being configured to convert display signals into images, and the optical amplifying component being configured to project the images to the front of the user.

In an example, the warning device further comprises an audio output module which is configured to provide the obstacle information and/or the danger avoiding information to the user via audio.

In an example, at least four of the radars are provided, the radars being configured to respectively detect obstacles on the left, the right, the top and the rear of the head of the user.

In an example, the spectacle holder is provided with two spectacle frames. The spectacle belts comprise one main belt and two auxiliary belts; two ends of the main belt being respectively connected with two sides of the spectacle holder; one end of the two auxiliary belts being respectively connected with the spectacle frames; and the other end of the two auxiliary belts being respectively connected with the main belt.

In an example, one radar is disposed on each auxiliary belt and each side of the spectacle holder, respectively.

In an example, the at least one spectacle frame is provided with an infrared camera; an input end of the microprocessor being connected with the infrared camera; and the infrared camera being configured to detect the pupil movement of the user, so that the user can send a control signal by the movement of the pupil.

In an example, the intelligent control system further comprises a water temperature sensor, a pressure sensor, a flow velocity sensor and a water quality monitor, which are respectively connected with input ends of the microprocessor. The water temperature sensor is configured to detect water temperature signals. The pressure sensor is configured to detect water pressure signals. The flow velocity sensor is configured to detect water velocity signals. The water quality monitor is configured to detect water quality signals. The microprocessor determines underwater environment information and/or danger avoiding information according to the signals, and provides the information to the user through the warning device.

In an example, the intelligent control system further comprises a heart rate detecting sensor connected with an input end of the microprocessor. The heart rate detecting sensor is configured to detect heart rate signals of the user; and the microprocessor is configured to receive the heart rate signals, determine physical condition information and/or danger avoiding information, and provide the information to the user through the warning device.

In an example, underwater spectacles further comprise a camera, the camera being configured to acquire images of the underwater environment and provide the images of the underwater environment to the display module for being displayed to the user.

In an example, the underwater spectacles are also provided with a searchlight; the searchlight being disposed on a side of the spectacle holder; and the camera being disposed on the other side of the spectacle holder.

In an example, the intelligent control system further comprises a wireless transceiver module; the wireless transceiver module being connected with an output end of the microprocessor and configured to transfer data between the microprocessor and other devices.

In an example, the intelligent control system further comprises a SOS button; the SOS button being disposed on the spectacle holder, connected with the wireless transceiver module, and configured to send an SOS to the outside through the wireless transceiver module.

In an example, the intelligent control system further comprises a power supply module for providing electricity power.

In an example, the intelligent control system is provided with a biological switch; the biological switch being configured to detect the arteries of the user, and automatically turn on the power supply module for power supply when the artery information of the user in water is detected.

In an example, the power supply module comprises an accumulator and a power supply circuit. The underwater spectacles further comprise a power generation device. The power generation device comprises a turbo and an electric generator. The turbo is disposed on the spectacle holder and connected with the electric generator through a driving shaft; and the electric generator is connected with an accumulator through a charging circuit and configured to charge the accumulator.

Embodiments of the present disclosure also provide a control method of underwater spectacles. The underwater spectacles comprise: a spectacle holder, spectacle belts for wearing and fastening, and an intelligent control system, in which the intelligent control system comprises a warning device, a microprocessor and a plurality of radars; and the control method comprises: acquiring signals of the plurality of radars via the microprocessor, and determining obstacle information and/or danger avoiding information according to the signals; and sending the obstacle information and/or the danger avoiding information to the warning device to allow the warning device to provide the obstacle information and/or the danger avoiding information to the user.

BRIEF DESCRIPTION OF THE DRAWINGS

Embodiments of the present disclosure will be described in more detail below with reference to accompanying drawings to allow an ordinary skill in the art to more clearly understand embodiments of the present disclosure, in which.

DETAILED DESCRIPTION

Figure 1:
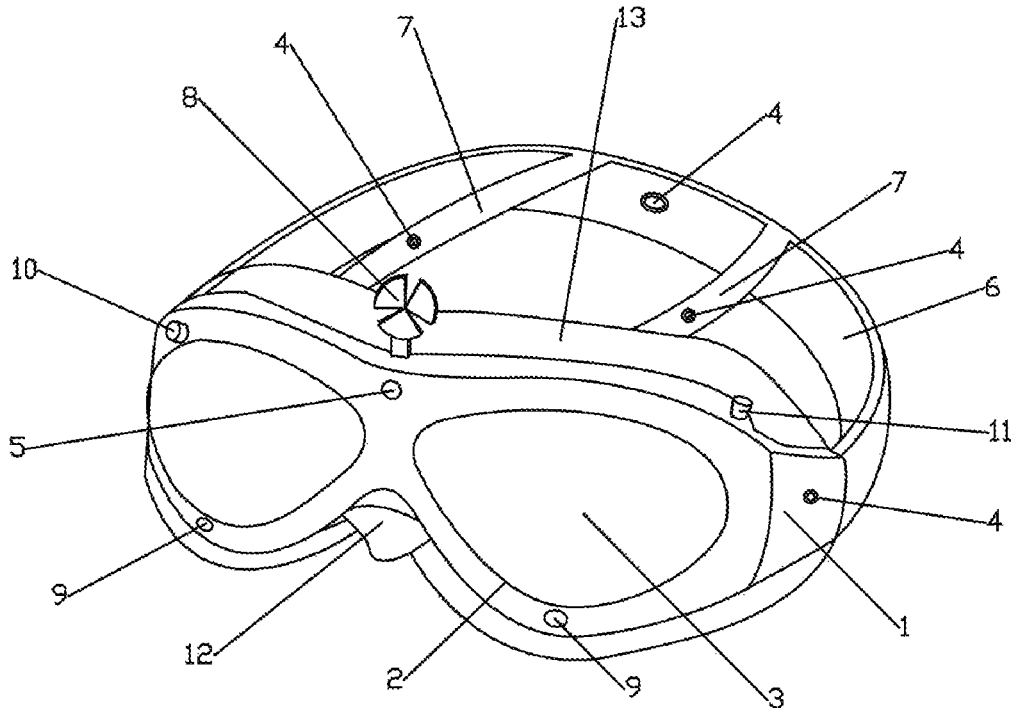
FIG. 1 is a perspective view of an example of underwater spectacles provided by an embodiment of the present disclosure.
Figure 2:
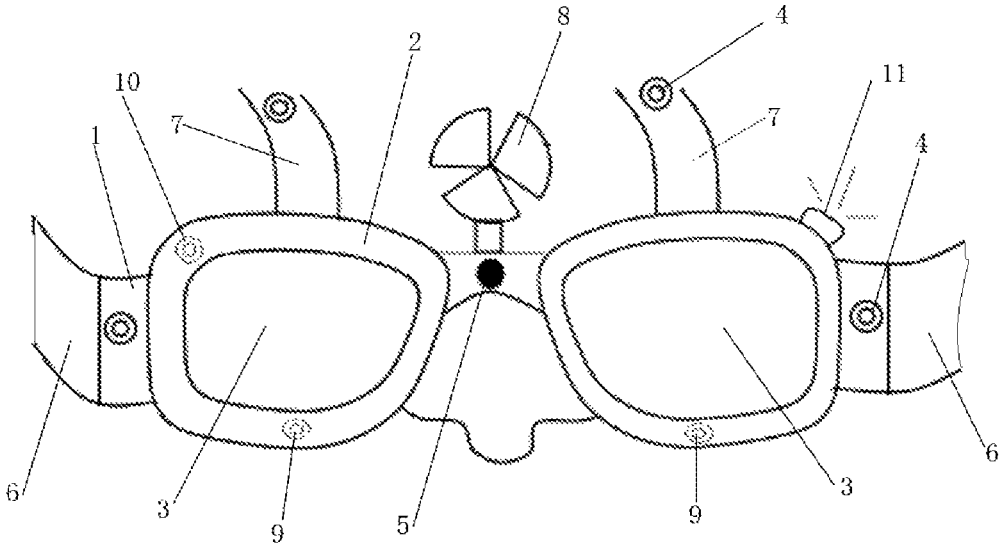
FIG. 2 is a front view of the underwater spectacles provided by the embodiment of the present disclosure.
Figure 3:
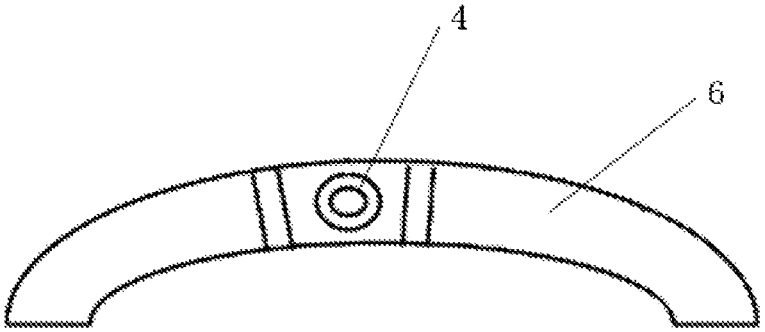
FIG. 3 is a front view of a main belt in the underwater spectacles provided by the embodiment of the present disclosure.

Technical solutions according to the embodiments of the present disclosure will be described clearly and fully as below in conjunction with the accompanying drawings of embodiments of the present disclosure. It is apparent that the described embodiments are just a part but not all of the embodiments of the disclosure. Based on the described embodiments herein, a person of ordinary skill in the art can obtain other embodiment(s), without any creative work, which shall be within the scope of the present disclosure.

In the description of embodiments of the present disclosure, unless otherwise specified or defined, the terms "mount/mounting/mounted", "connecting/connected" and "connection" shall be broadly understood, for instance, it may refer to a fastening connection, or a detachable connection, or integral connection; it may refer to a mechanical connection, or an electrical connection; it refer to a direct connection, or an indirect connection through an intermediate medium; or it may refer to a communication of the inside of two elements. The specific meanings of the above terms in the embodiments of the present disclosure shall be understood by an ordinary skill in the art according to specific situation in the embodiments.

The inventor has found that the underwater spectacles (the swimming goggles or the diving mask) worn by a swimmer can only obverse the environment before eyes and cannot acquire information from the top, the rear, the left and the right, so it is difficult to ensure safety.

In addition, normal underwater spectacles cannot receive information from the outside or send information about the underwater situation to the outside, meanwhile, cannot acquire the index of physical function and the calories consumed during exercise. Further more, the water quality and the safety of public waters cannot be acquired.

An embodiment of the present disclosure provides underwater spectacles, which, as shown in FIGS. 1 to 4, comprise a spectacle holder 1, spectacle belts for wearing and fastening, and an intelligent control system. Spectacle frames 2 are disposed on the spectacle holder 1 and configured to mount spectacle lenses 3 thereon. The intelligent control system includes a warning device, a microprocessor 101 and a plurality of radars 4. The plurality of radars 4 are respectively disposed on the spectacle holder 1 and/or the spectacle belts. Input ends of the microprocessor 101 are respectively connected with the plurality of radars 4, and an output end of the microprocessor 101 is connected with the warning device. The microprocessor 101 is configured to acquire signals of the radars 4, determine obstacle information and/or danger avoiding information around the head of a user wearing the underwater spectacles, and send the information to the warning device. The warning device is configured to receive and provide the user with the obstacle information and/or the danger avoiding information. A nose cover 12 and a waterproof skirt 13 are disposed on the spectacle holder 1. The number of the spectacle frames 2 may be varied. One spectacle frame 2 may be provided, or two spectacle frames 2 may be provided. As shown in the drawings, in the embodiment, two spectacle frames 2 are provided.

The radars of the underwater spectacles provided by the embodiment of the present disclosure can detect the obstacle information and/or the danger avoiding information around the head of the user, and provide the information to the user through the warning device, so that the user can avoid danger action in time according to the obstacle information and/or the danger avoiding information. When the underwater spectacles provided by the embodiment of the present disclosure are worn, the head safety of the user can be improved.

The warning device includes a display module 5 which is configured to provide the obstacle information and/or the danger avoiding information to the user via images. The user can acquire the obstacle information and/or the danger avoiding information (e.g., dangerous alarm/tip information and/or danger avoiding suggestion information) sent by the microprocessor 101 through the images. In the embodiment, the display module 5 includes an image converting component and an optical amplifying component. The image converting component is configured to convert display signals into images. The optical amplifying component is configured to project the images to the front of the user. In the underwater environment, as the transmission capacity of light is weaker, the user may utilize a water curtain in front as a virtual screen projected by the display module. The image converting component is a liquid crystal on silicon (LCOS) or an organic light-emitting diode display (OLED). The optical amplifying component may select a commonly used projecting lens capable of projecting the image to 1 to 2 meters in front of the user. As shown in FIG. 1, the display module 5 is disposed in the vertical center of the spectacle holder 1, so that the displayed image can be always presented in front of the user for the convenience of viewing.

The warning device may also include an audio output module 105 configured to provide the obstacle information and/or the danger avoiding information to the user via audio. The audio output module 105 is provided with a headset interface for connecting a headset. The user can acquire the obstacle information and/or the danger avoiding information sent by the microprocessor 101 through audio, so obtain double warning or reminding, so that the safety performance of the spectacles can be improved.

The warning device on the spectacles provided by the embodiment of the present disclosure may also remind the user by vibration or the like, except the reminding ways by the display module and the audio output module.

For instance, at least four radars are provided, and the radars are respectively configured to detect obstacles on the left, the right, the top and the rear of the head of the user. It is noted that the number of the radars is not limited to be more than 4. For instance, the safety function can also be achieved when three radars are provided. Therefore, the embodiment of the present disclosure is not limited thereto.

For instance, the structure of the spectacle belts is various and may be set according to the application environment. The spectacle belts include one main belt 6 and two auxiliary belts 7. Two ends of the main belt 6 are respectively connected with two sides of the spectacle holder 1; one end of the two auxiliary belts 7 is respectively connected with the spectacle frames 2; and the other end of the two auxiliary belts 7 is respectively connected with the main belt 6. By adoption of the spectacle belt structure in the embodiment, the underwater spectacles can have advantages of good fastening performance, comfortable wearable and safety. In an embodiment, the number of the radars 4 may be 5, in which one radar is respectively disposed on two sides of the spectacle frames and at positions on the auxiliary belts at the top of the head, and one radar is also disposed at a central position of the hindbrain after the main belt is put on, so as to improve the safety effect. The spectacle belts may be integrated with a flexible circuit board (FCB). The radars 4 are connected with the microprocessor 101 through the FCB. When the number of the radars is 4, each auxiliary belt 7 is provided with one radar 4, and one radar 4 is respectively disposed on two sides of the spectacle holder 1. But the embodiments of the present disclosure are not limited thereto.

The spectacle frame 2 is provided with an infrared camera 9. Input ends of the microprocessor 101 are connected with the infrared cameras 9 to detect the pupil movement of the user, so that the user can send a control signal by the movement of the pupil.

Figure 4:
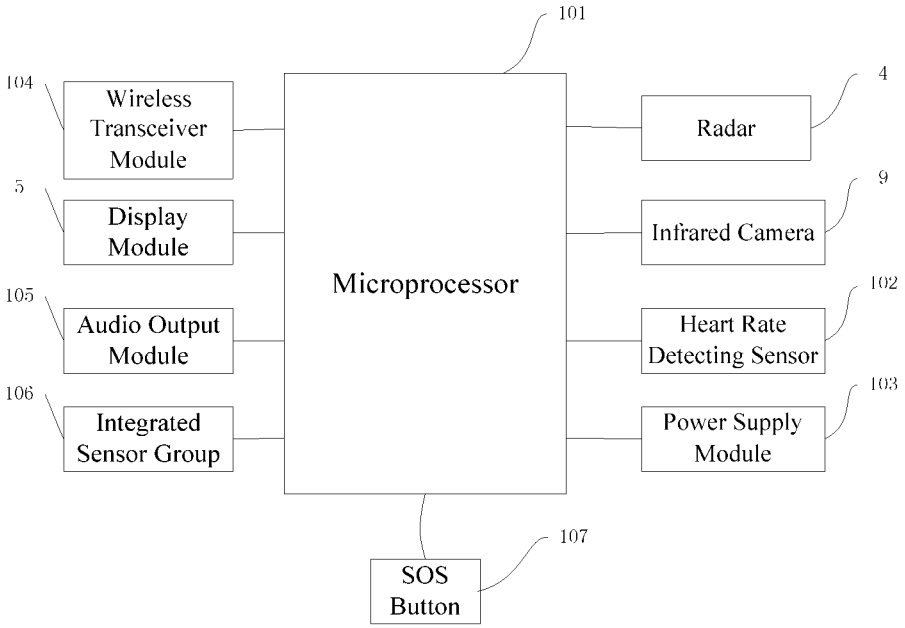
FIG. 4 is a connection diagram of an intelligent control system in an underwater spectacles provided by an embodiment of the present disclosure.

For instance, the intelligent control system further includes a water temperature sensor (not shown in the figure), a pressure sensor (not shown in the figure), a flow velocity sensor (not shown in the figure) and a water quality monitor (not shown in the figure) which are respectively connected with input ends of the microprocessor 101. The water temperature sensor is configured to detect water temperature signals. The pressure sensor is configured to detect water pressure signals. The flow velocity sensor is configured to detect water velocity signals. The water quality monitor is configured to detect water quality signals. The microprocessor 101 determines underwater environment information including water temperature information, water pressure information, water flow velocity information and water quality information according to the signals, and provides the information to the user through the warning device. The water temperature information, the water pressure information, the water flow velocity information and the water quality information may also be taken as parameters for forming the danger avoiding information for the user. After calculation, the danger avoiding information is sent to the user; or the danger avoiding information is directly calculated and provided for the user through the warning device. The user can acquire the information outputted by the display module and the audio processing module at any time, master underwater information and own physical information, and can conveniently make security judgment. As shown in FIG. 4, the water temperature sensor, the pressure sensor, the flow velocity sensor and the water quality monitor may be integrated into an integrated sensor group 106.

The intelligent control system further includes a heart rate detecting sensor 102 connected with an input end of the microprocessor 101. The heart rate detecting sensor 102 is configured to detect heart rate signals of the user. The microprocessor 101 receives the heart rate signals and determines physical condition information and/or danger avoiding information, and provides the information to the user through the warning device. For instance, the heart rate detecting sensor 102 is disposed in an area above the eyes, close to the temporal artery of the head, feeds back the heart rate by detecting temporal artery information, and feeds back the calories consumed and the oxygen consumption to the user. The user can acquire the amount of exercise or the underwater physical condition in time, so as to reduce the probability of danger.

The intelligent control system further includes a wireless transceiver module 104. The wireless transceiver module 104 is connected with an output end of the microprocessor 101 and configured to achieve data exchange between the microprocessor 101 and other devices. Other devices may include a background server or other interconnection of devices, such as smart phones, and smart terminals, for data exchange.

The underwater spectacles further include a camera 10. The camera 10 is configured to capture underwater environment. The content of the underwater environment captured by the camera 10 is stored into a memory. The camera 10 may also be connected with the wireless transceiver module 104 and sends image information of the underwater environment to other devices through the wireless transceiver module 104.

For instance, the intelligent control system may also include an SOS button 107. The SOS button 107 (not shown) may be disposed on the spectacle holder. The SOS button 107 is connected with the wireless transceiver module 104 and configured to send an SOS to the outside through the wireless transceiver module 104, so that the user can send out the SOS to the outside in time when in danger.

The underwater spectacles may also comprise a searchlight 11. The searchlight 11 may be disposed on a side of the spectacle holder 1, and the camera 10 may be disposed on the other side of the spectacle holder 1. The searchlight 11 is mounted on the spectacle holder 1 through a universal joint, which provides convenience for the user to adjust the direction of the searchlight 11 and expands the scope of lighting.

The intelligent control system is provided with a power supply module 103 for providing electricity energy. The intelligent control system may also be provided with a biological switch (not shown). The biological switch is configured to detect the arteries of the user, and automatically turn on the power supply module 103 for power supply when the artery information of the user in water is detected. By using the biological switch, as long as the user wears the underwater spectacles, the switch can be automatically turned on, so that the safety performance can be improved.

For instance, the power supply module 103 includes an accumulator and a power supply circuit. The underwater spectacles may further comprise a power generation device. The power generation device includes a turbo 8 and an electric generator (not shown). The turbo 8 is disposed on the spectacle holder 1 and connected with the electric generator through a driving shaft. The electric generator is connected with the accumulator through a charging circuit and configured to charge the accumulator. When the user wears the underwater spectacles and swims underwater and moves forwards, fans of the turbo 8 enter into the water stream and are swirled by the water to rotate, so as to drive the electric generator to generate power. The electric generator is provided with a rectifier circuit and charges the accumulator through the charging circuit after rectification. For instance, the accumulator is a lithium battery which has light weight and large energy storage. By using the power generation device, the endurance time of the underwater spectacles can be prolonged, and the safety performances can be improved.

In addition, the memory of the underwater spectacles may also store film or music content, and the display module 103 and the audio output module 105 are adopted to play audio and video programs. When the microprocessor determines that the user is in danger, the microprocessor 101 controls the interrupt of the audio and video program and provides the danger avoiding information to the user. Network signals of external video programs may also be received for playing through the wireless transceiver module 104.

The radars of the underwater spectacles provided by embodiments of the present disclosure may detect the obstacle information and/or the danger avoiding information around the head of the user, and provide the information to the user through the warning device, so that the user can avoid danger action in time according to the obstacle information and/or the danger avoiding information. When the underwater spectacles provided by the embodiment of the present disclosure are worn, the head safety of the user can be improved.

The described above are only exemplary embodiments of the present disclosure, and the present disclosure is not intended to be limited thereto. For one of ordinary skill in the art, various changes and alternations may be made without departing from the technical scope of the present disclosure, and all of these changes and alternations shall fall within the scope of the present disclosure.

The application claims priority to the Chinese patent application No. 201610079581.1, filed on Feb. 4, 2016 and entitled "Underwater Spectacles and Control Method thereof", which is incorporated herein by reference in its entirety.

What is claimed is:

1. Underwater spectacles, comprising: a spectacle holder, spectacle belts for wearing and fastening, and an intelligent control system, wherein the intelligent control system comprises a warning device, a microprocessor and a plurality of radars; the plurality of radars being respectively disposed on at least one of the spectacle holder, or the spectacle belts; input ends of the microprocessor being respectively connected with the plurality of radars; an output end of the microprocessor being connected with the warning device; the microprocessor being configured to acquire signals of the radars, determine at least one of obstacle information, or danger avoiding information around the head of a user wearing the underwater spectacles according to the signals dynamically acquired in real time, and send the information to the warning device; and the warning device being configured to receive and provide the user with the at least one of the obstacle information, or the danger avoiding information.

2. The underwater spectacles according to claim 1, wherein the warning device comprises a display module which is configured to provide the at least one of the obstacle information, or the danger avoiding information to the user via images.

3. The underwater spectacles according to claim 2, wherein the display module comprises an image converting component and an optical amplifying component; the image converting component being configured to convert display signals into images, and the optical amplifying component being configured to project the images to the front of the user.

4. The underwater spectacles according to claim 1, wherein the warning device further comprises an audio output module which is configured to provide at least one of the obstacle information, or the danger avoiding information to the user via audio.

5. The underwater spectacles according to claim 1, wherein at least four of the radars are provided, the radars being configured to respectively detect obstacles on the left, the right, the top and the rear of the head of the user.

6. The underwater spectacles according to claim 1, wherein the spectacle holder is provided with two spectacle frames; and the spectacle belts comprise one main belt and two auxiliary belts; two ends of the main belt being respectively connected with two sides of the spectacle holder; one end of the two auxiliary belts being respectively connected with the spectacle frames; and the other end of the two auxiliary belts being respectively connected with the main belt.

7. The underwater spectacles according to claim 6, wherein one radar is disposed on each auxiliary belt and each side of the spectacle holder, respectively.

8. The underwater spectacles according to claim 6, wherein the at least one spectacle frame is provided with an infrared camera; an input end of the microprocessor being connected with the infrared camera; and the infrared camera being configured to detect the pupil movement of the user, so that the user can send a control signal by the movement of the pupil.

9. The underwater spectacles according to claim 1, wherein the intelligent control system further comprises a water temperature sensor, a pressure sensor, a flow velocity sensor and a water quality monitor, which are respectively connected with input ends of the microprocessor; the water temperature sensor being configured to detect water temperature signals; the pressure sensor being configured to detect water pressure signals; the flow velocity sensor being configured to detect water velocity signals; the water quality monitor being configured to detect water quality signals; and the microprocessor being configured to determine at least one of underwater environment information, or danger avoiding information according to the signals, and provide the information to the user through the warning device.

10. The underwater spectacles according to claim 1, wherein the intelligent control system further comprises a heat rate detecting sensor connected with an input end of the microprocessor; the heart rate detecting sensor being configured to detect heart rate signals of the user; and the microprocessor being configured to receive the heart rate signals, determine at least one of physical condition information, or danger avoiding information, and provide the information to the user through the warning device.

11. The underwater spectacles according to claim 2, further comprising a camera, wherein the camera is configured to acquire images of the underwater environment and provide the images of the underwater environment to the display module for being displayed to the user.

12. The underwater spectacles according to claim 11, wherein the underwater spectacles are also provided with a searchlight; the searchlight being disposed on a side of the spectacle holder; and the camera being disposed on the other side of the spectacle holder.

13. The underwater spectacles according to claim 1, wherein the intelligent control system further comprises a wireless transceiver module; the wireless transceiver module being connected with an output end of the microprocessor and configured to transfer data between the microprocessor and other devices.

14. The underwater spectacles according to claim 13, wherein the intelligent control system further comprises a SOS button; the SOS button being disposed on the spectacle holder, connected with the wireless transceiver module, and configured to send an SOS to the outside through the wireless transceiver module.

15. The underwater spectacles according to claim 1, wherein the intelligent control system further comprises a power supply module for providing electricity power.

16. The underwater spectacles according to claim 15, wherein the intelligent control system is provided with a biological switch; the biological switch being configured to detect the arteries of the user, and automatically turn on the power supply module for power supply when the artery information of the user in water is detected.

17. The underwater spectacles according to claim 15, wherein the power supply module comprises an accumulator and a power supply circuit.

18. The underwater spectacles according to claim 17, further comprising a power generation device, wherein the power generation device comprises a turbo and an electric generator; the turbo being disposed on the spectacle holder and connected with the electric generator through a driving shaft; and the electric generator being connected with a accumulator through a charging circuit and configured to charge the accumulator.

19. A control method of underwater spectacles, wherein the underwater spectacles comprise: a spectacle holder, spectacle belts for wearing and fastening, and an intelligent control system, in which the intelligent control system comprises a warning device, a microprocessor and a plurality of radars; and the control method comprises:

acquiring signals of the plurality of radars via the microprocessor, and determining at least one of obstacle information, or danger avoiding information according to the signals dynamically acquired in real time; and sending the at least one of the obstacle information, or the danger avoiding information to the warning device to allow the warning device to provide the at least one of the obstacle information, or the danger avoiding information to the user.

* * * * *